US007617660B2

(12) United States Patent
Morand

(10) Patent No.: US 7,617,660 B2
(45) Date of Patent: Nov. 17, 2009

(54) APPARATUS FOR FORMING WASTE CONTAINING PACKS

(75) Inventor: Michel Morand, Montreal (CA)

(73) Assignee: International Refills Company Ltd., Christ Church (BB)

( * ) Notice: Subject to any disclaimer, the term of this patent is extended or adjusted under 35 U.S.C. 154(b) by 0 days.

(21) Appl. No.: 11/577,691

(22) PCT Filed: Jul. 27, 2006

(86) PCT No.: PCT/CA2006/001253

§ 371 (c)(1),
(2), (4) Date: Feb. 4, 2008

(87) PCT Pub. No.: WO2007/028230

PCT Pub. Date: Mar. 15, 2007

(65) Prior Publication Data

US 2008/0184677 A1 Aug. 7, 2008

(30) Foreign Application Priority Data

Sep. 7, 2005 (CA) ..... 2518325

(51) Int. Cl.
*B65B 9/10* (2006.01)

(52) U.S. Cl. ..... 53/567; 53/390; 53/574; 53/576

(58) Field of Classification Search ..... 53/567, 53/576, 390, 459, 469, 574
See application file for complete search history.

(56) References Cited

U.S. PATENT DOCUMENTS

| | | | | |
|---|---|---|---|---|
| 2,671,906 | A * | 3/1954 | Potts | 4/484 |
| 4,550,553 | A * | 11/1985 | Gaither | 56/202 |
| 4,869,049 | A | 9/1989 | Richards et al. | |
| 5,782,067 | A * | 7/1998 | Fuss et al. | 53/576 |
| 5,890,351 | A * | 4/1999 | Shiotari | 53/567 |
| 6,370,847 | B1 * | 4/2002 | Jensen et al. | 53/459 |
| 7,406,814 | B2 * | 8/2008 | Morand | 53/567 |
| 2005/0044819 | A1 * | 3/2005 | Chomik et al. | 53/459 |

FOREIGN PATENT DOCUMENTS

| | | |
|---|---|---|
| CA | 2236361 | 5/1999 |
| CA | 2236384 | 6/2003 |
| CA | 2372143 | 8/2003 |
| CA | 2441837 | 5/2004 |
| JP | 2005231670 A * | 9/2005 |

* cited by examiner

*Primary Examiner*—Thanh K Truong
(74) *Attorney, Agent, or Firm*—Novak Druce + Quigg; J. Rodman Steele, Jr.; Gregory M. Lefkowitz

(57) ABSTRACT

An apparatus for forming waste containing packs from a length of flexible tubing is formed of a housing having a top portion, an intermediate portion and a lower portion. The top portion displays an opening to receive waste material therein and a cassette containing a package of a flexible pleated tubing. The intermediate portion has a retractable guillotine-type member sealingly contacting the tubing dispensed from the cassette and extending downwardly into the lower portion of the housing. Retraction of the member causes waste material received in the tubing of the upper and intermediate portions of the housing to be dispensed in a closed end tubing in the lower portion of the house.

10 Claims, 7 Drawing Sheets

APPARATUS FOR FORMING WASTE CONTAINING PACKS

CROSS-REFERENCE TO RELATED APPLICATIONS

This application is the National Phase Entry of PCT Application No. PCT/CA2006/001253 filed on Jul. 27, 2006 and published in English under PCT Article 21(2), which claims priority to Canadian Application No. 2,518,325, filed on Sep. 7, 2005, the entire contents of both of which are herein incorporated by reference.

FIELD OF THE INVENTION

The present invention relates to an apparatus for forming waste containing packs from a length of flexible tubing.

BACKGROUND OF THE INVENTION

It is known, for the disposal of waste material, to use packs of flexible tubing wherein waste material is packaged in individual packs along a length of such flexible tubing. One example of such apparatus using packs of flexible tubing for the ready disposal of babies' disposable nappies may be found described in U.S. Pat. No. 4,869,049 issued Sep. 26, 1989 to Richards et al. In this patent, a core is used and turned to twist the flexible material at locations between adjacent waste containing packs to seal the packs at their ends thereby providing hygienic disposal of the waste material. The packages are collected in a bin portion of the apparatus and when it is desired to remove the packages from the bin portion, the bottom of the apparatus is opened to discharge the packages to a waste disposal facility. A similar apparatus may also be found described in Canadian patent application No. 2,372,143 published Aug. 15, 2003.

OBJECTS AND STATEMENT OF THE INVENTION

It is an object of the present invention to provide an improved apparatus for forming waste containing packs from a length of flexible tubing.

The apparatus comprises:

a housing including a bottom portion, an intermediate portion and a top portion; the top portion displaying an opening to receive waste material therethrough;

a cassette mounted in the top portion and containing a package of flexible pleated tubing; the cassette being so constructed as to enable tubing to be dispensed therefrom and downwardly into the intermediate and lower portions of the housing; the tubing in the bottom portion having a closed end; and a guillotine-type member mounted in the intermediate portion of the housing and movable between an inward tubing engaging position and an outward retracted position; the member having an outer end extending outside the housing and an inner end extending in the intermediate portion of the housing to contactingly squeeze the tubing thereby forming a lower waste receiving tubing compartment and an upper waste receiving tubing compartment; whereby waste material received through the opening and in the upper compartment is dispensed, upon retraction of the member, into the lower compartment and whereby, when the inner end of the member is in the tubing squeezing position, the waste material in the lower compartment is sealingly enclosed therein.

In one form of the invention, the housing has a cutter for separating a waste containing pack from the tubing.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
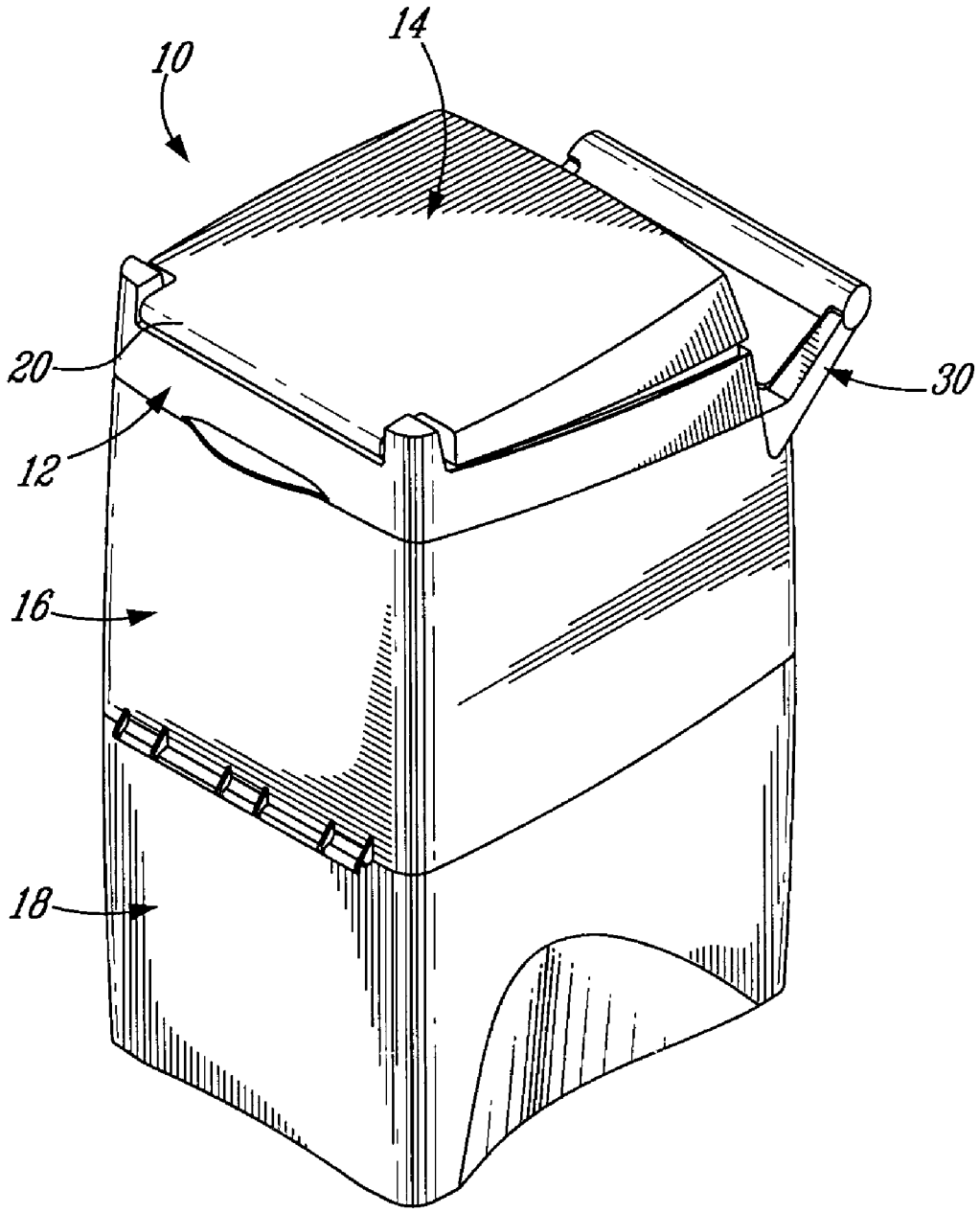
FIG. 1 is a perspective view showing one side of an apparatus for forming waste containing packs made in accordance with the present invention.
Figure 2:
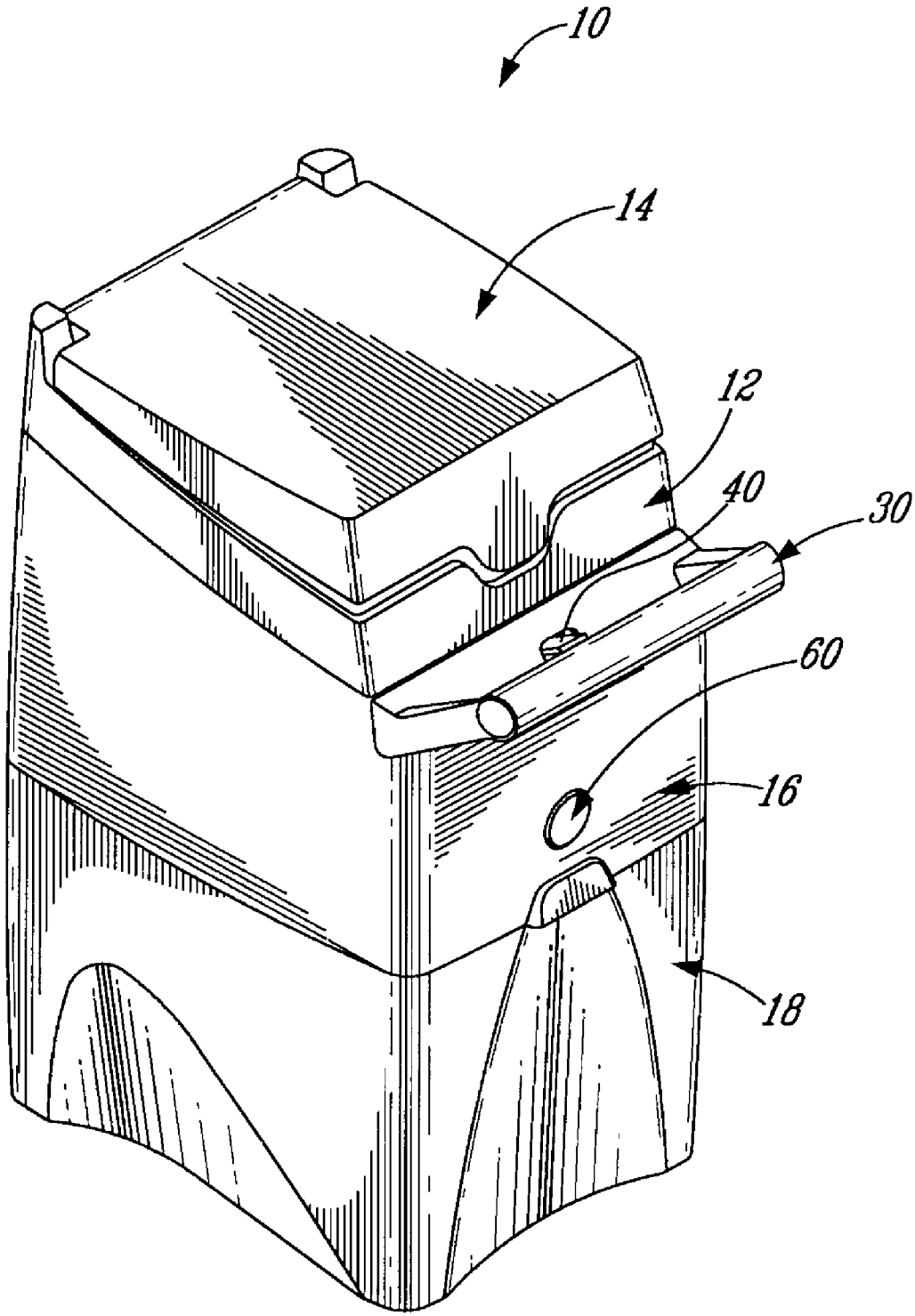
FIG. 2 is a perspective view showing another side of the apparatus.
Figure 3:
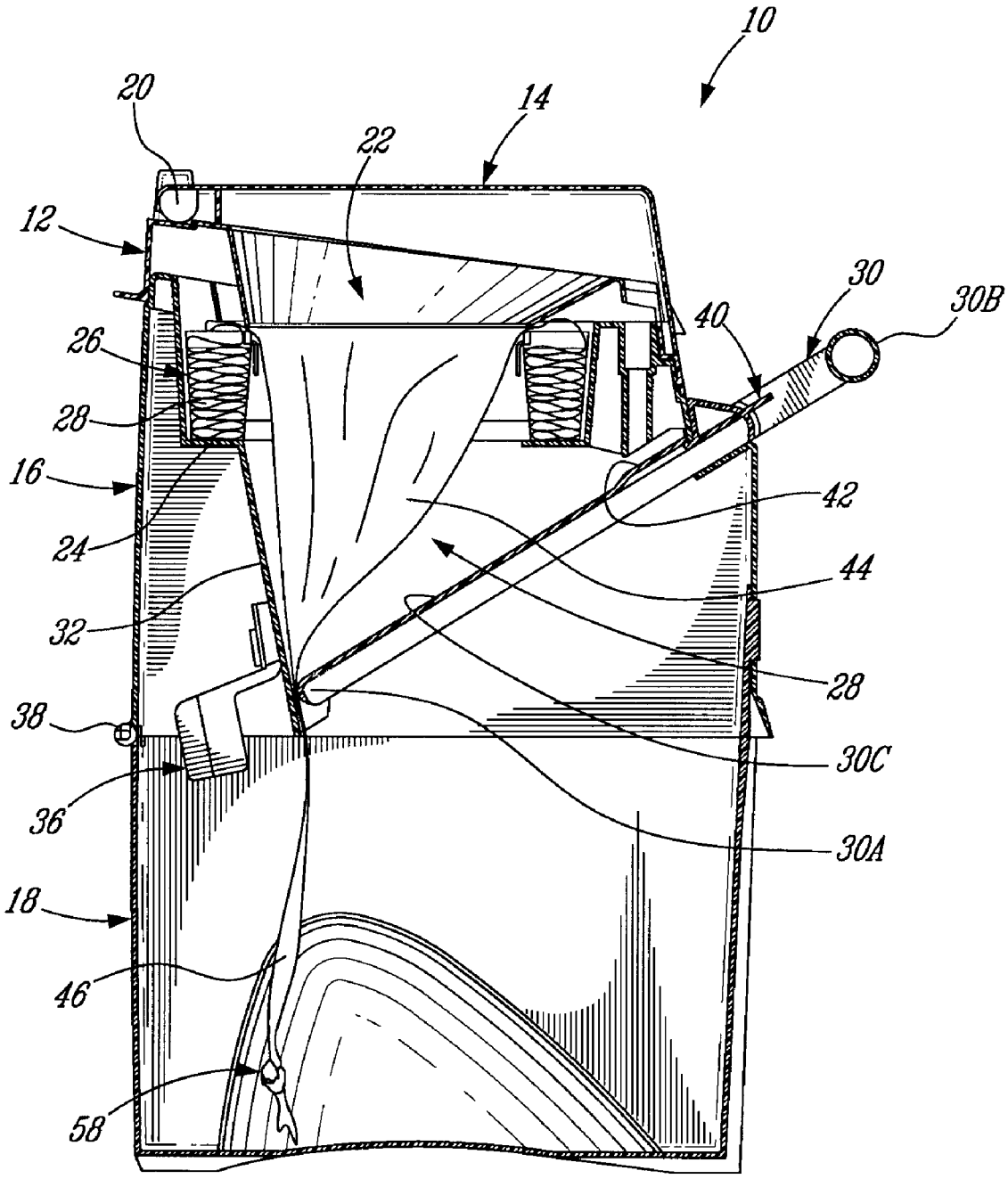
FIG. 3 is an elevational cross-sectional view showing the apparatus without waste material therein.

Referring to FIGS. 1, 2 and 3, there is shown an apparatus, generally denoted 10, for forming waste containing packs in accordance with the present invention.

The apparatus comprises an enclosed housing formed of a top portion 12 having a cover 14, an intermediate portion 16 and a bottom portion 18. Cover 14 is hingedly connected to the top portion 12 at edge 20.

Top portion 12 has a funnel shaped opening 22 and is provided with a base area 24 to support a cassette 26 containing a package of flexible pleated tubing 28. Such cassette may be found described in applicant's Canadian patent application no. 2,366,384 published Aug. 15, 2003.

The intermediate portion 16 is constructed to receive a guillotine-type sliding member 30 having an inner end **30*a* extending inside the intermediate portion and an outer side 30*b* extending outside the housing and defining the shape of a handle. Member has a smooth top surface 30C. The intermediate portion 16 also includes an inclined back plate 32 the function of which will be described further hereinbelow. Mounted to the rear wall of plate 32, is a cutter 36, the function of which will be also described below. The intermediate portion 16 is hingedly connected at edge 38 to the bottom portion 18 to provide access to contents inside the bottom portion 18**.

A locking arrangement in the form of a clamp finger 40 is provided on member 30 to secure the latter to the intermediate portion 16 and to facilitate the displacement of the apparatus by a user. By depressing finger 40, the protuberance 42 will free the adjacent wall of the intermediate portion of the housing, thus allowing full retraction of the sliding member.

For the operation of the apparatus of the present invention, a length of tubing is first drawn through the center portion of the cassette and a knot 58 is made to form a closed end. The length of tubing should be at least sufficient to contact and lie on the bottom wall of the bottom portion of the housing. The cassette is placed in the top portion of the apparatus and the housing is hingedly closed. The member 30 is slid into the intermediate portion until the end 30*a* contactingly squeezes the tubing against the back plate 32 thereby forming in the tubing inside the housing an upper compartment 44 and a lower compartment 46.

Figure 4:
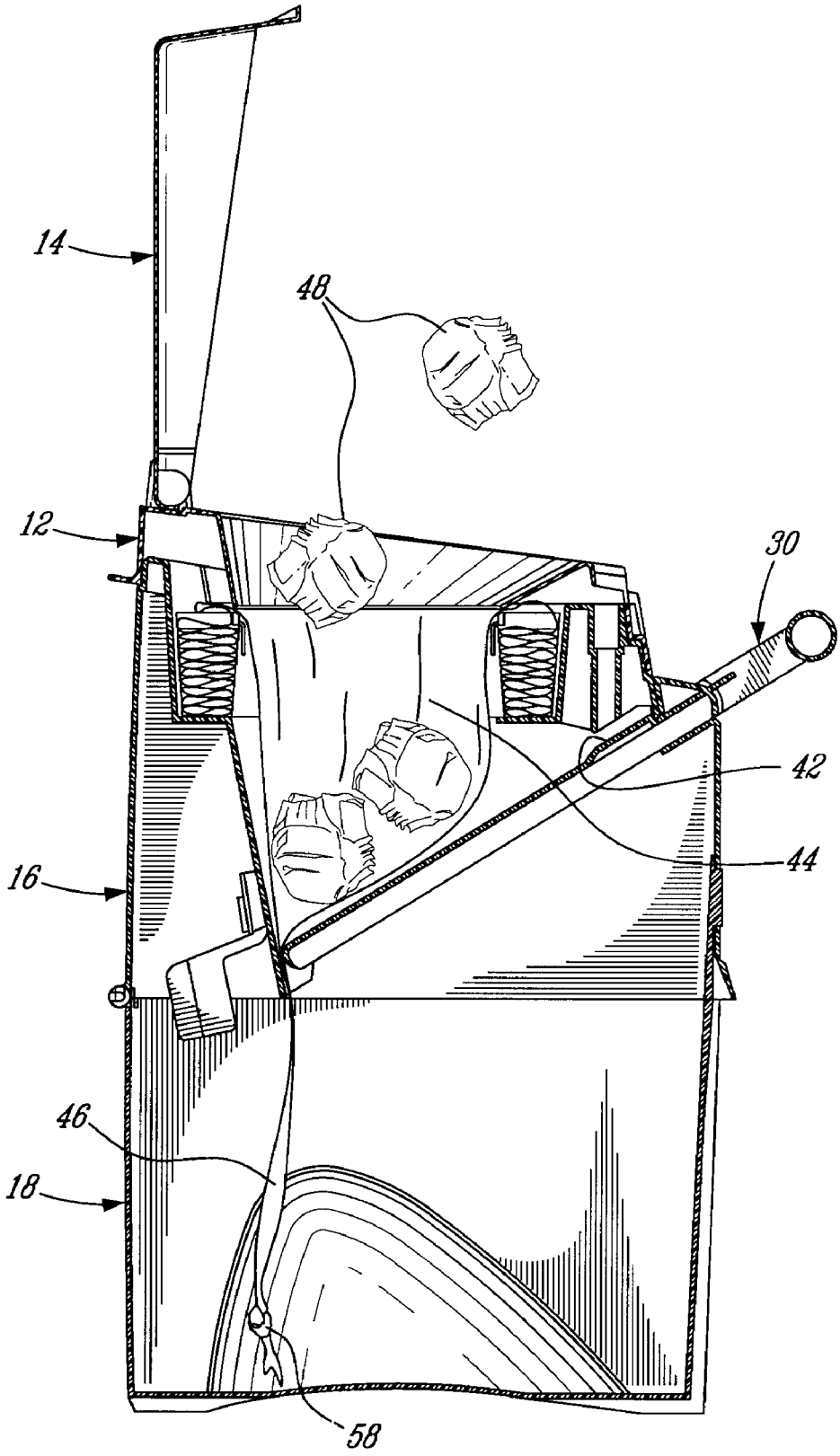
FIG. 4 is a cross-sectional view similar to FIG. 3, but showing waste material being dropped in the top portion of the housing.
Figure 5:
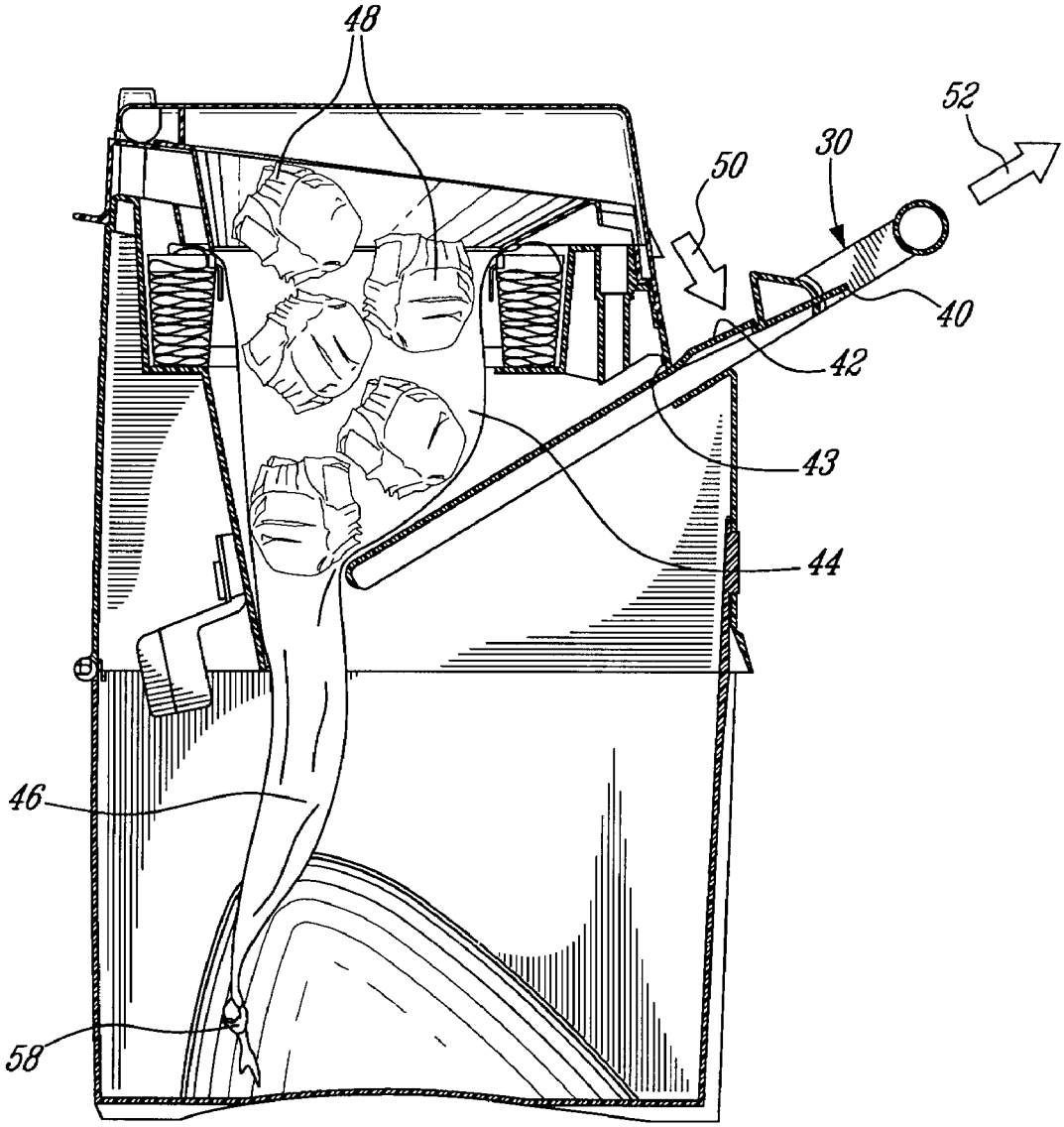
FIGS. 5 and 6 are cross-sectional views showing two positions of the retracting guillotine-type member.
Figure 6:
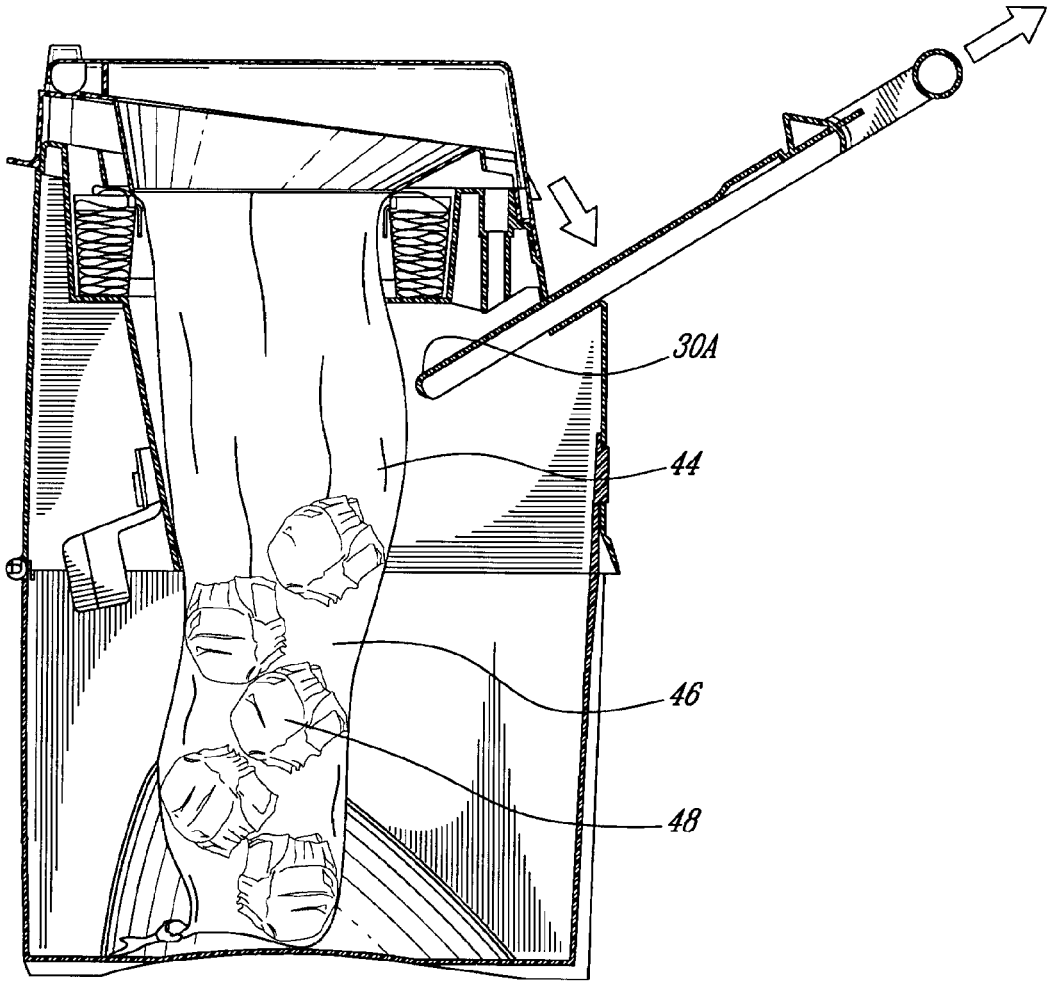
Figure 7:
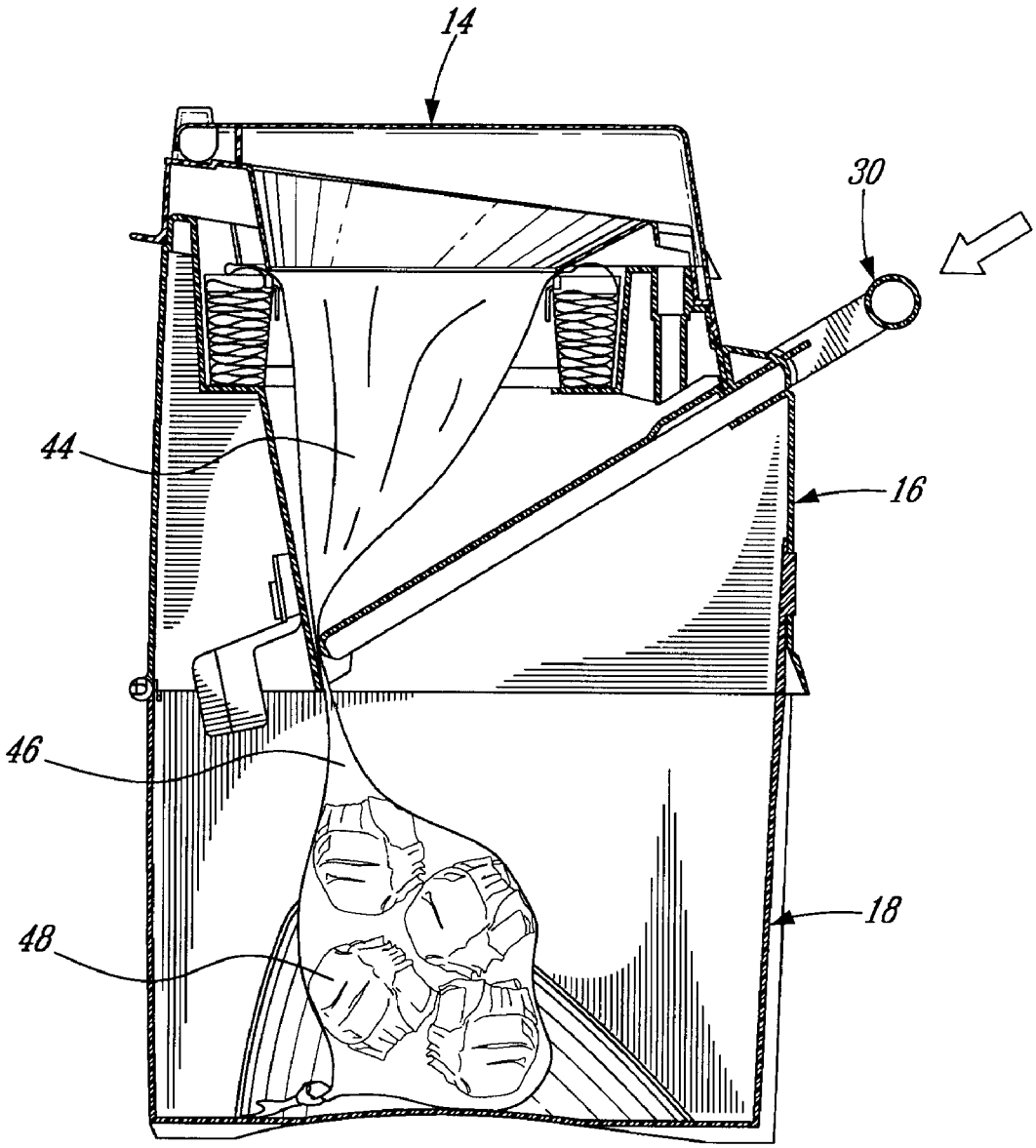
FIG. 7 is a cross-sectional view showing waste material sealingly enclosed in the lower portion of the housing.

Referring to FIG. 4, the cover 14 is lifted so that waste material 48 may be deposited through the funnel shape opening 22 of the top portion into the upper compartment 44 of the tubing. Cover 14 is then closed. The clamp finger 40 is depressed in the direction indicated by arrow 50 so that the protuberance 42 may free the edge 43 of the wall of the intermediate portion. As the sliding member 30 is retracted in the direction indicated by arrow 52, the waste material 48 drops in the lower compartment 46 of the tubing (see FIG. 6).

Thereafter, the sliding member is reinserted in the direction opposite to the direction 52 to again have its end 30*a* squeeze the tubing against the back plate 32 of the intermediate portion. This contact ensures that odours of the waste material 48 is sealingly enclosed in the lower compartment 46 of the tubing.

When it is wished to remove the packed content of the bottom portion, button 60 forming part of the front wall of the lower portion 18 is inwardly depressed so that the intermediate portion with the top portion and its cover the edge 38. The user uses cutter 36 to sever the lower compartment 46 from the rest of the tubing. A pair of notches is made, one (not shown) for the severed end of the pack containing the waste material, the other (similar to knot 58) for the severed free open of the length of tubing extending from the cassette to form another waste material receiving compartment in the lower portion of the housing.

Although the invention has been described above in relation to one specific form, it will be evident to a person skilled in the art that it may be refined and varied. For example, a scoop holder may be attached to or molded directly to the housing. Also, the bottom portion can be made part of a cat liter box. It is therefore wished to have it understood that the present invention should not be limited in interpretation except by the terms of the following claims.

I claim:

1. An apparatus for forming waste containing packs from a length of flexible tubing comprising:

a housing including a bottom portion, an intermediate portion and a top portion; said top portion displaying an opening to receive waste material therethrough;

a cassette mounted in said top portion and containing a package of flexible pleated tubing; said cassette being so constructed as to enable tubing to be dispensed therefrom and downwardly into said intermediate and lower portions of said housing; said tubing in said bottom portion having a closed end;

a sliding member mounted in said intermediate portion of the housing and movable between an inward tubing engaging position and an outward retracted position; said member having an outer end extending outside said housing and an inner end extending in said intermediate portion of said housing to contactingly squeeze said tubing thereby forming a lower waste receiving tubing compartment and an upper waste receiving tubing compartment; whereby waste material received through said opening and in said upper compartment is dispensed, upon retraction of said member, into said lower compartment and whereby, when said inner end of said member is in said tubing squeezing position, the waste material in said lower compartment is sealingly enclosed therein; and a lock on the sliding member for locking said sliding member in said tubing squeezing position, the lock lockingly engaging the housing solely when the sliding member reaches the tubing squeezing position; said lock being disengageable for retraction of said member from said intermediate portion of the housing.

2. An apparatus as defined in claim 1, wherein said outer end of said member defines a handle.

3. An apparatus as defined in claim 1, wherein said lower portion of said housing is hingedly connected to said intermediate portion to provide access to contents in said lower portion of said housing.

4. An apparatus as defined in claim 1, further comprising a cover hingedly connected to said top portion of the housing.

5. An apparatus as defined in claim 1, wherein said intermediate portion includes a back plate cooperating with said member to define said tubing squeezing position.

6. An apparatus as defined in claim 1, further comprising cutter means in said housing allowing said lower compartment of said tubing to be severed from said upper compartment.

7. An apparatus as defined in claim 1, wherein said closed end consists in a notch formed at an open end of said tubing.

8. An apparatus as defined in claim 1, wherein the lock is a protuberance on the sliding member releasably engaging the housing.

9. An apparatus as defined in claim 8, wherein the lock further comprises a finger being manually depressed to release the protuberance from the housing.

10. An apparatus as defined in claim 1, wherein the sliding member is inclined in the housing with respect to the horizontal.

* * * * *